United States Patent [19]

Müller et al.

[11] Patent Number: 4,764,208

[45] Date of Patent: Aug. 16, 1988

[54] METHOD OF IGNITING A PLASMA ARC AS WELL AS AN ARRANGEMENT FOR CARRYING OUT THE METHOD

[75] Inventors: Heinz Müller, Neuhofen; Reinhard Buzzi, Stainach; Gerhard Scheiblhofer, Linz, all of Austria

[73] Assignee: Voest-Alpine Aktiengesellschaft, Linz, Austria

[21] Appl. No.: 125,466

[22] Filed: Nov. 25, 1987

[30] Foreign Application Priority Data

Dec. 1, 1986 [AT] Austria ..... 3194/86

[51] Int. Cl.[4] ..... C22B 4/00; H05B 7/18

[52] U.S. Cl. ..... 75/10.19; 373/18; 373/22

[58] Field of Search ..... 75/10.19; 373/18, 22

[56] References Cited

U.S. PATENT DOCUMENTS 4,061,493 6/1977 Jaeger ..... 75/10.19
4,518,417 5/1985 Lugscheider ..... 75/10.19
4,518,419 5/1985 Lugscheider ..... 75/10.19
4,519,835 5/1985 Gauvin ..... 75/10.19
4,699,653 10/1987 Barcza ..... 75/10.19

*Primary Examiner*—Peter D. Rosenberg
*Attorney, Agent, or Firm*—Hopgood, Calimafde, Kalil, Blaustein & Judlowe

[57] ABSTRACT

An auxiliary plasma arc fed by an auxiliary circuit serves for igniting a plasma arc, fed by a main circuit, of a plasma burner provided in a metallurgical furnace vessel.

To increase the service lives of the burners, the electrode of the plasma burner and the melting stock charged in the furnace vessel are applied to the auxiliary circuit, with the main circuit switched off, and an auxiliary plasma arc is ignited between the plasma burner and the melting stock, whereupon the plasma burner is moved back from the melting stock, thereby lengthening the auxiliary plasma arc, and subsequently the main circuit is applied to the plasma burner and to the melting stock, and the plasma arc is ignited.

10 Claims, 2 Drawing Sheets

METHOD OF IGNITING A PLASMA ARC AS WELL AS AN ARRANGEMENT FOR CARRYING OUT THE METHOD

The invention relates to a method of igniting a main-circuit-fed plasma arc of a plasma burner provided in a metallurgical furnace vessel by means of an auxiliary plasma arc fed by an auxiliary circuit, as well as an arrangement for carrying out the method.

It has been known here to ignite the plasma burner with the help of an auxiliary arc, wherein with the main circuit already applied to the plasma burner, an auxiliary plasma arc is ignited between the electrode of the plasma burner and a burner jacket surrounding the electrode, and, by the addition of gas, is blown to a length of approximately 10 cm, whereupon the plasma burner is advanced to the melting stock charged into the furnace vessel, until the main plasma arc ignites. Thereupon the plasma burner is moved back into the desired position.

Herein it is disadvantageous that, in case of a contact between the melting stock and the burner jacket, current having a high intensity may flow between the electrode and the burner jacket, a so-called secondary arc forming thereby. This secondary arc, due to its high current intensity, may lead to the destruction of the burner jacket.

Furthermore, it may happen that splashes of the melting stock, which particularly occur during ignition, hit the burner jacket or the electrode of the plasma burner, respectively, which leads to pronounced erosions on the same. This results in a considerable shortening of the service lives of the burners and a simultaneous great divergence of the service lives of the burners, which greatly impairs the reliability and economy of a plasma furnace: The great divergence of the service lives of the burners renders impossible a preventive exchange of burners which could still be justified for economical reasons. Such a preventive exchange of burners is, however, necessary, because exchanging burners while melting a charge causes complications.

The invention aims at avoiding these disadvantages and difficulties and has as its object to provide a method for igniting a plasma arc as well as an arrangement for carrying out that method, which safeguard long and uniform service lives of the burners, in particular with high-performance furnaces.

With a method of the initially defined kind, this object is achieved in that, while the main circuit is switched off, the electrode of the plasma burner and the melting stock charged in the furnace vessel are applied to the auxiliary circuit and an auxiliary plasma arc is ignited between the plasma burner and the melting stock, whereupon the plasma burner is moved back from the melting stock while lengthening the auxiliary plasma arc and subsequently the main circuit is applied to the plasma burner and the melting stock, and the plasma arc is ignited.

Since the plasma arc is ignited only when the plasma burner is at a safe distance from the melting stock, splashes occurring during the ignition procedure can no longer reach the plasma burner. During ignition of the auxiliary plasma arc, a contact between the burner and the melting stock makes no difference, because the current of the auxiliary circuit flowing there causes neither a destruction of the electrode of the plasma burner, nor of the burner jacket. Since the plasma arc is ignited only when the plasma burner is far away from the melting stock, damage to the electrode of the plasma burner or to the burner jacket cannot occur, even if the slag cover has poor conductivity or the furnace atmosphere is cold, i.e. at short ignition intervals.

To avoid a contact between the melting stock and the plasma burner in principle, preferably prior to ignition of the auxiliary plasma arc burning between the melting stock and the plasma burner, an auxiliary plasma arc is ignited with the help of the auxiliary circuit between the electrode of the plasma burner and the burner jacket surrounding the electrode and applied to the auxiliary circuit, which preferably lies at the same potential as the melting stock, whereupon the plasma burner is moved towards the melting stock until this auxiliary plasma arc flashes over to the melting stock.

Preferably, after flow of at least a partial current of the auxiliary arc burning between the melting stock and the electrode, the burner jacket is separated from the auxiliary circuit.

Advantageously, the current of the auxiliary circuit flowing over the melting stock is measured, and a switching device switching off the burner jacket from the auxiliary circuit is actuated in dependence on the current of the auxiliary circuit measured, whereby the thermal load of the burner can be kept very low and consequently time and energy are saved. Advantageously, the switching device is actuated already when a partial current flows. Furthermore, the burner need not be moved any closer than is absolutely necessary for igniting the melting stock. This method step also allows for a fully automated control of the ignition procedure.

Furthermore, advantageously the voltage of the auxiliary current is measured after ignition of the auxiliary arc between the plasma burner and the melting stock, and the main circuit is switched on in dependence on the voltage measured. Thereby the plasma burner is switched on automatically, whithout having to measure the distance between the burner and the melting stock or having to observe this distance. This saves time and energy.

The arrangement for carrying out the method with a metallurgical vessel having a plasma burner, which plasma burner is connectable to a main circuit and to an auxiliary circuit and is movable to different levels relative to the bottom of the furnace vessel by means of an adjustment drive, is characterised in that the auxiliary circuit is in flow-connection with the melting stock via a conduit provided with a switching device.

According to a preferred embodiment, the auxiliary circuit is connectable to the burner jacket by a conduit branching off the conduit that leads to the melting stock and equipped with a switching device.

Advantageously, a current-intensity-measuring device is provided in the conduit leading to the melting stock, which device—via a control conduit—is connected with the switching device provided in the conduit leading to the burner jacket.

Suitably, a voltage-measuring device is provided in the auxiliary circuit, which voltage-measuring device is connected with a switching device provided in the main circuit via a control conduit.

The invention will now be explained in more detail by way of two exemplary embodiments and with reference to the drawings, wherein.

Figure 1:
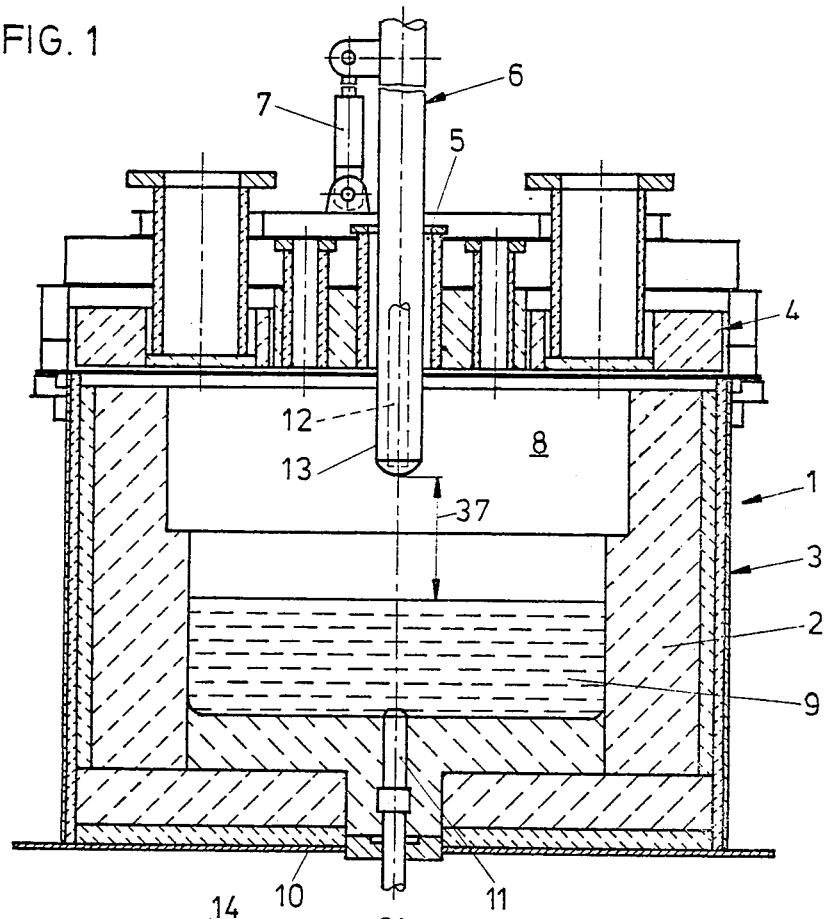
FIG. 1 is a vertical section through a furnace vessel.
Figure 3:
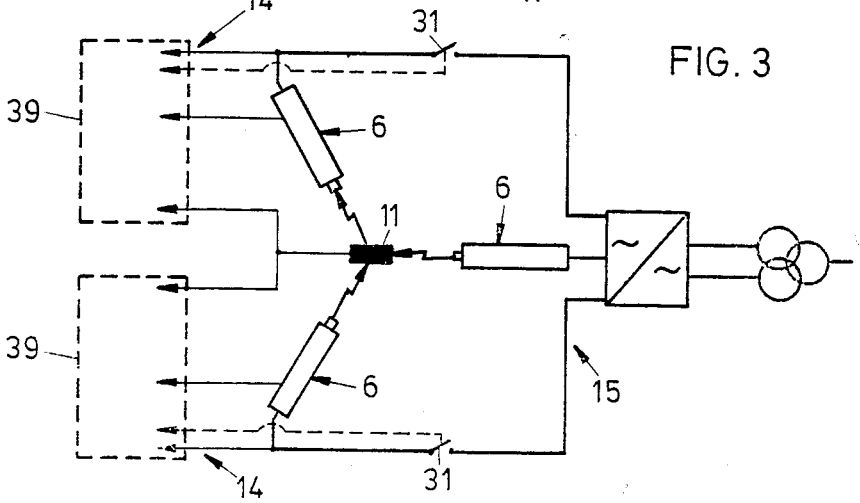

FIG. 3 schematically illustrates a switching diagram for a rotary current plasma burner.

A plasma furnace 1 includes a furnace vessel 3 provided with a refractory lining 2 and is covered by a lid 4. Centrally in the lid 4, an opening 5 is provided, through which a plasma burner 6 projects. The plasma burner 6 is liftable and lowerable by means of an adjustment drive 7, so that it is movable towards and away from the melting stock 9 charged into the furnace interior 8. In the bottom 10 of the furnace vessel 3, a bottom electrode 11 is centrally arranged so as to be opposite to the plasma burner 6.

The plasma burner 6 is formed by a central electrode 12 and a preferably water-cooled burner jacket 13 surrounding the electrode. The plasma burner 6 and the bottom electrode 11 (and thus the melting stock 9) are connectable to an auxiliary circuit 14 and/or to a main circuit 15.

The source of current of the auxiliary circuit 14 is denoted by 16. It is connected with the electrode 12 of the plasma burner 6 via a main switch 17, via a transformer 18 and via a rectifier 19 by means of a conduit 20 connected to the negative potential, and with the melting stock 9 via the bottom electrode 11 bymeans of a conduit 21 laid at the positive potential. Both, in the conduit 20 leading to the electrode 12 and in the conduit 21 leading to the melting stoc 9, switching devices 22, which are controllable in common, are present. In the conduit 20 leading to the electrode 12 of the plasma burner 6, furthermore a drop resistor 23 for restricting the current and for determining the operating point is provided. A choke inserted between the transformer 18 and the rectifier 19 has the same effect.

A conduit 24 laid at the jacket 13 of the plasma burner 6 branches off the conduit 21 leading to the melting stock 9, in which conduit 24 a switching device 25 for selectively connecting the jacket 13 to the auxiliary circuit 14 is provided. Between the branch-off 26 of the conduit 24 leading the jacket 13 and the connection to the bottom electrode 11, an amperemeter 27 is provided, and between that amperemeter 27 and the connection to the bottom electrode 11 a further switching device 28 is provided.

Between the conduit 20 leading to the electrode 12 of the plasma burner 6 and the conduit 21 leading to the bottom electrode 11, a voltmeter 29 is installed, which is connected with a switching device 31 via a control conduit 30, the switching device 31 being provided in the main circuit 15. The main circuit 15 is connected to a main source of current 32 via transformer 33 and a rectifier 34. A direct current choke is prvoided between the switch device 31 of the main circuit 15 and the connection to the electrode 12 of the plasma burner 6 in order to smooth voltage fluctuations.

The arrangement functions in the following manner:

To ignite the plasma arc, at first the switching devices 22 provided in the conduits 20, 21 to the electrode 12 of the plasma burner 6 and to the bottom electrode 11 are closed, with the main circuit 15 being switched off, the switching device 28, however, staying open. Thereupon, the switching device 25 provided in the conduit 24 connected to the burner jacket 13, and the main switching device 17 of the auxiliary circuit 14 are closed. The burner jacket 13 and the melting stock 9 do not yet have the same potential.

Subsequently, an auxiliary plasma arc is ignited between the burner electrode 12 and the burner jacket 13 by means of an auxiliary ignition device 36. There, the plasma burner 6 is still located at a farther distance 37 to the melting stock 9 (or to the bath surface, respectively).

Upon closure of the switching device 28 provided between the amperemeter 27 and the bottom electrode 11, the plasma burner is moved closer to the melting stock 9 by means of the adjustment drive 7, i.e. so far, until an auxiliary plasma arc ignites between the melting stock 9 and the burner electrode 12, or the auxiliary plasma arc first ignited between the burner jacket 13 and the electrode 12 of the plasma burner 6 sparks over to the melting stock 9 due to the slighter voltage drop. For determining this spark-over, the amperemeter 27 is provided. As soon as the latter records a certain minimum value, the burner jacket 13 is separated from the auxiliary circuit 14, i.e. by opening the switching device 25 provided in the conduit 24 leading to the burner jacket 13. This is effected via a control conduit 38 connecting the switching device 25 with the amperemeter 27. Thus, all the current of the auxiliary circuit 14 is conducted via the bottom electrode 11.

Subsequently, the plasma burner 6 is moved back from the melting stock 9, whereby the auxiliary plasma arc burning between the burner electrode 12 and the melting stock 9 is lengthened. As soon as the voltage of the current flowing between the melting stock 9 and the burner electrode 12 exceeds a certain height, which, among other things, depends on the distance of the plasma burner 6 from the melting stock 9, this being determined by means of the voltmeter 29, the main circuit 15 is applied to the melting stock 9 and the burner electrode 12 via the control conduit 30 leading from the voltmeter 29 to the switching device 31 of the main circuit 15, whereby the plasma arc ignites immediately. Suitably, this happens at a distance 37 of the plasma burner 6 from the melting stock, of approximately 30 cm. Thereupon, the auxiliary circuit 14 is separated both from the melting stock 9 and from the burner electrode 12, i.e. by opening the switching devices 17, 22 and 28.

Figure 2:
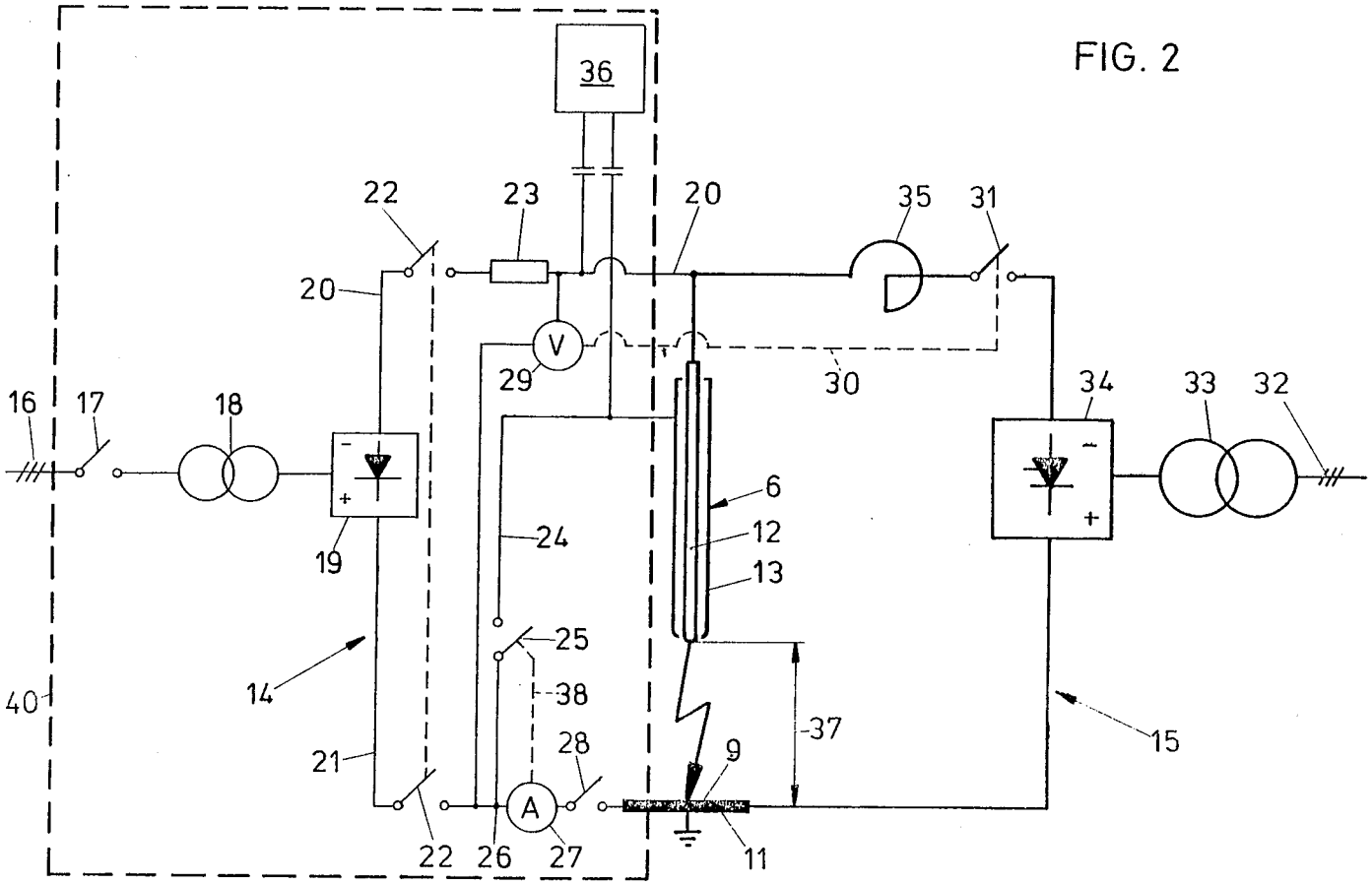
FIG. 2 is a switching diagram for carrying out the ignition procedure according to the invention.

The invention is not limited to the exemplary embodiment illustrated, but may be modified in various respects. It may be realized not only with direct current circuits, but also with alternating current circuits. A basic switching diagram for rotary currents is shown in FIG. 3, the igniting devices 39 indicated in broken lines there each comprising those switching parts that are included by the rectangle 40 formed by broken lines in FIG. 2.

What we claim is:

1. In a method of igniting a plasma arc fed by a main circuit, of a plasma burner including an electrode and a burner jacket surrounding said electrode, said plasma burner being provided in a metallurgical furnace vessel into which a melting stock has been charged, by means of an auxiliary plasma arc fed by an auxiliary circuit, the improvement comprising applying said electrode of said plasma burner and said melting stock in said furnace vessel to said auxiliary circuit, with said main circuit being switched off, igniting said auxiliary plamsa arc between said plasma burner and said melting stock, thereupon moving back said plasma burner from said melting stock, thereby lengthening said auxiliary plasma arc, and subsequently applying said main circuit to said plasma burner and to said melting stock and igniting said plasma arc.

2. A method as set forth in claim 1, further comprising igniting, by means of the auxiliary circuit, an auxiliary plasma arc between said electrode of said plasma burner and said burner jacket laid at said auxiliary circuit, prior to igniting said auxiliary plasma arc between said melting stock and said plasma burner, and subsequently moving said plasma burner towards said melting stock until said auxiliary plasma arc sparks over to said melting stock.

3. A method as set forth in claim 2, wherein said burner jacket is applied to the same potential as the melting stock.

4. A method as set forth in claim 2, further comprising separating said burner jacket from said auxiliary circuit after flow of at least a partial current of said auxiliary plasma arc burning between said melting stock and said electrode of said plasma burner.

5. A method as set forth in claim 4, further comprising measuring the current of the auxiliary circuit flowing over said melting stock, and actuating a switching device switching the burner jacket off said auxiliary circuit, which switching device is actuated in dependence on the current of said auxiliary circuit measured.

6. A method as set forth in claim 1, further comprising measuring the voltage of said auxiliary circuit after ignition of said auxiliary plasma arc between said plasma burner and said melting stock, and switching on said main circuit in dependence on the voltage measured

7. In an arrangement for igniting a plasma arc fed by a main circuit, by means of an auxiliary plasma arc fed by an auxiliary circuit, and of the type including a plasma burner connectable to said main circuit and to said auxiliary circuit and having an electrode and a burner jacket surrounding said electrode, a metallurgical furnace vessel for accommodating a melting stock and having a bottom, an adjustment drive for moving said plasma burner relative to said bottom of said metallurgical furnace vessel to various levels therein, the improvement comprising a first conduit flow-connecting said auxiliary circuit with said melting stock, and a first switching device provided in said first conduit.

8. An arrangement as set forth in claim 7, further comprising a further conduit provided in said auxiliary circuit and branching off said first conduit leading to said melting stock, and a further switching device provided in said further conduit, said auxiliary circuit being connectable to said burner jacket by said further conduit.

9. An arrangement as set forth in claim 8, further comprising a current-intensity measuring device provided in said first conduit leading to said melting stock, and a control conduit connecting said current-intensity measuring device with said further switching device in said further conduit leading to said burner jacket.

10. An arrangement as set forth in claim 7, 8 or 9, further comprising a voltage measuring device provided in said auxiliary circuit, a third switching device provided in said main circuit, and a further control conduit connecting said voltage measuring device with said third switching device.

* * * * *